United States Patent [19]

Porter

[11] Patent Number: 4,653,125

[45] Date of Patent: Mar. 31, 1987

[54] PORTABLE SANITARY FACILITY

[76] Inventor: Robert M. Porter, 6147 E. Turquoise, Scottsdale, Ariz. 85253

[21] Appl. No.: 852,026

[22] Filed: Apr. 14, 1986

[51] Int. Cl.[4] ..... E03D 13/00

[52] U.S. Cl. ..... 4/301; 4/300; 4/321; 4/341; 4/663; 4/664

[58] Field of Search ..... 4/663, 664, 300, 301, 4/302, 307, 311, 312, 321, 323, 661, 596; D23/48, 49, 50

[56] References Cited

U.S. PATENT DOCUMENTS

| | | | |
|---|---|---|---|
| 743,834 | 11/1903 | Danner | 4/461 |
| 1,514,157 | 11/1924 | Harding | 4/321 |
| 2,817,091 | 12/1957 | Painter | 4/341 X |
| 2,817,846 | 12/1957 | Stift | 4/301 |
| 2,907,048 | 10/1959 | Gould | 4/663 |
| 3,110,907 | 11/1963 | King | 4/663 |
| 3,594,825 | 7/1971 | Reid | 4/323 |
| 3,668,710 | 6/1972 | Dowd | 4/341 |
| 3,992,727 | 11/1976 | Elkins | 4/311 |
| 4,008,496 | 2/1977 | Johansson | 4/597 |
| 4,348,777 | 9/1982 | Peterson | 4/596 |

*Primary Examiner*—Henry K. Artis
*Attorney, Agent, or Firm*—Charles E. Cates

[57] ABSTRACT

A portable sanitary facility is disclosed which, in one embodiment is particularly adapted for use by males needing only to relieve themselves of liquid body wastes. A sanitary unit is carried by a trailer to achieve portability between a use station and a disposal site. The sanitary unit includes a main compartment more or less encompassed by a trough with apertures being provided in the compartment walls to drain liquid introduced into the trough into the compartment interior. The main compartment is divided into a plurality of sub-compartments by transverse vertical baffles which include a series of apertures for establishing liquid communication between the subcompartments. The baffles serve to prevent shifting of the liquid load and thus stabilize the trailer during transport to a disposal site. A valved outlet is provided to permit draining the facility at a disposal site. Removable access covers permit entry into the facility interior during fabrication, maintenance and cleaning. In a second female or all-purpose embodiment a plurality of toilet seats and aperture over each subcompartment are provided in the top of the compartment to receive solid and liquid wastes, and modesty apartment means enclose each seat to give privacy. Means for converting solid waste to liquid waste are provided.

10 Claims, 6 Drawing Figures

FIG. 3
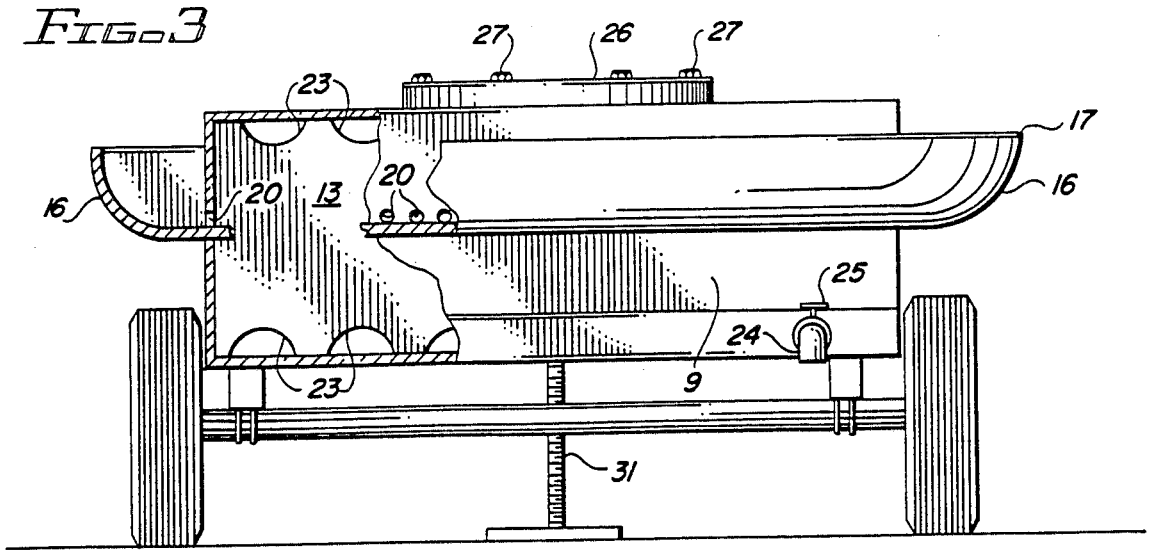
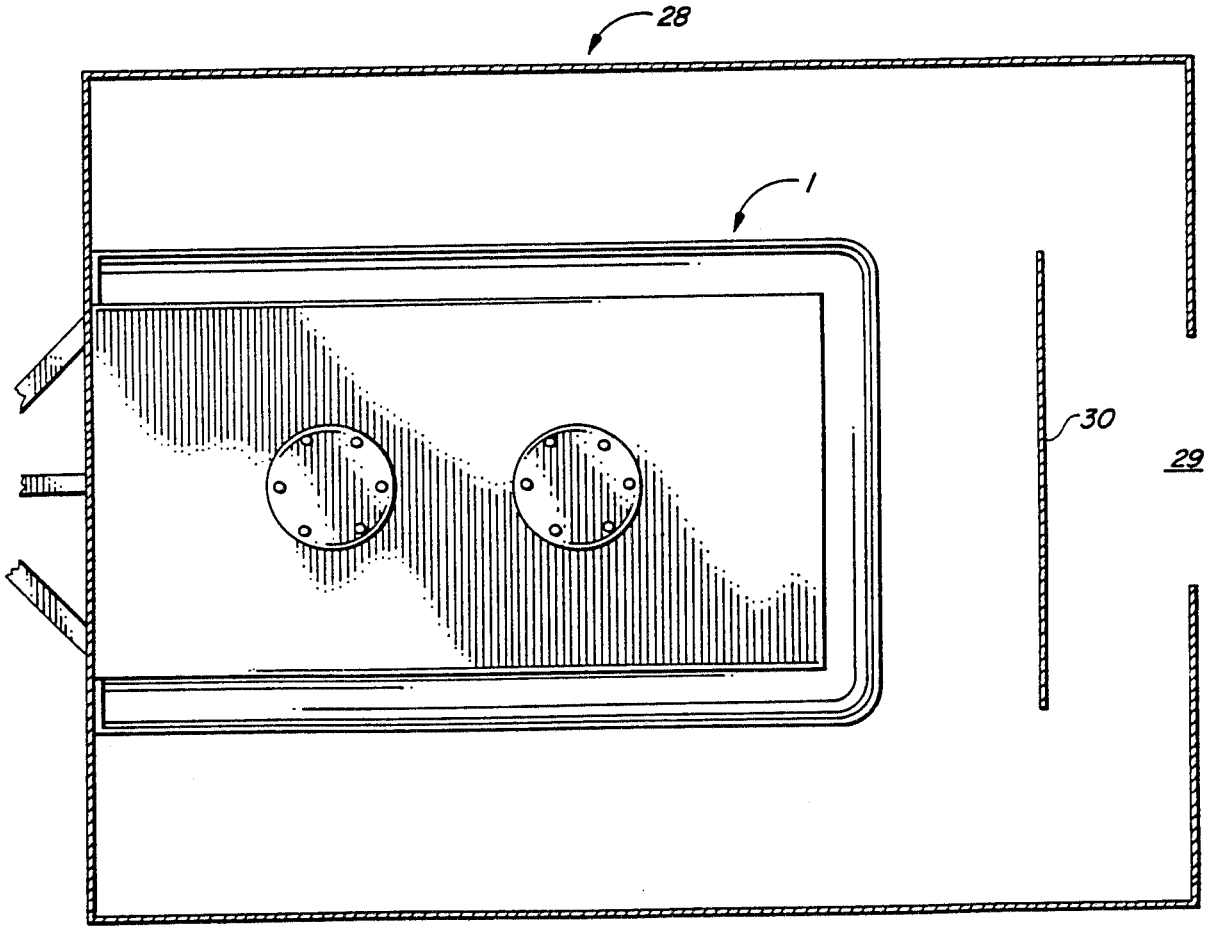
FIG. 4

PORTABLE SANITARY FACILITY

FIELD OF THE INVENTION

This invention relates to the sanitary facility arts, and more particularly, to a portable sanitary facility for large scale use, and in one embodiment to such a facility especially adapted for use by males.

BACKGROUND OF THE INVENTION

A fundamental necessity at such heavily attended events as outdoor concerts and athletic contests, as well as at recreational facilities such as state and national parks, and at large scale, but temporary construction sites, etc. are facilities for collecting and dealing with human wastes. The facilities often provided are characterized by the provision of individual stations capable of accommodating only one person at a time, primarily in deference to the sensibilities and physical requirements of females.

However, in some instances, the overall capacity of a sanitary facility may be significantly improved by providing entirely separate installations for males who need only to relieve themselves of liquid body waste; for example, at events which are male oriented and in which massive quantities of soft drinks, and beer and the like are consumed, such special purpose installations can handle a large percentage of the sanitary facility system demand.

For the most part, in the past, special purpose sanitary facilities, if provided, have been more or less built in and not portable. For large scale events at which portable sanitary facilities have been brought in, such facilities have typically been of the individual station type and hence strictly limited in their ability to handle large numbers of users. As a result, temporary sanitary facilities often either fall far short of the event requirements or the cost of providing a genuinely adequate facility capacity is significant.

In recognition of this dilemma, those skilled in the art will appreciate that it would be highly desirable to provide a readily portable special purpose sanitation facility to accommodate both sexes (and especially male users needing only to relieve themselves of body liquid waste) which stores such waste in liquid form for subsequent transport to and disposal at a remote disposal site.

OBJECTS OF THE INVENTION

It is therefore a broad object of my invention to provide an improved portable sanitary facility.

It is another object of my invention to provide such a portable sanitary facility which is particularly adapted to receive in large quantities and store, for later disposal at a remote site, body waste including solid waste to be transformed to liquid waste.

It is a more specific object of my invention to provide such a portable sanitary facility which is simple to transport and set up which, when loaded, may be safely transported to a disposal site at which the liquid waste may be thoroughly and cleanly drained from the facility storage means.

SUMMARY OF THE INVENTION

Briefly, these and other objects of the invention are achieved by providing the sanitary units hereafter described carried by a trailer having a trailer frame supported on wheels including a trailer hitch adapted for coupling to a towing vehicle.

In one preferred embodiment a male oriented sanitary unit is carried by the trailer and includes a main compartment more or less encompassed by a trough with apertures being provided in the compartment walls to drain liquid introduced into the trough into the compartment interior.

Preferably, the compartment is divided into a plurality of sub-compartments by transverse vertical baffles in which are formed a series of apertures for establishing liquid communication between adjacent sub-compartments. The baffles serve to prevent shifting of the liquid load during subsequent towing, which shifting would otherwise result from acceleration and deceleration and side-to-side motion of the trailer. Therefore, stability of the trailer during the towing process with a liquid load is very much improved over a similar facility not incorporating the vertical baffles.

A valved outlet is provided at a low point at the rear of the compartment to close off the compartment during use and transport of the facility and to permit the simple and thorough draining of the facility at a disposal site.

In a second embodiment a sanitary unit carried by the trailer contains a main compartment divided into a plurality of sub-compartments by transverse vertical baffles in which are formed a series of apertures for establishing liquid communication between adjacent sub-compartments. The main compartment has a top wall or surface which has at least one opening, with associated means defining a toilet seat, for the dropping of solid waste. In this second embodiment a chemical liquefacient, e.g., an enzymatic waste digester, which may be obtained from Thetford Corporation, Ann Arbor, Mich., under the brand name Aqua Zyme is placed into the compartment and appropriate sub-compartments before use for the purpose of liquefying solid waste.

In either event, the first or the second embodiment will have a suitable screening means to prevent passers-by from viewing the process of passing solid and liquid body waste. For example, embodiment No. 1 may be protected from public view by a simple above-head high screen surrounding the entire facility and embodiment No. 2 is preferably protected from public view by a series of compartments built around each toilet seat facility.

In a third embodiment the first and second embodiments are combined and each is screened from view of non-users.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing in which:

FIG. 3 is a partially cut away rear view of the portable sanitary facility of FIGS. 1 and 2 which view shows certain details of the internal baffle structure as well as the orientation of a valved outlet conduit utilized for draining the facility at a disposal site;

FIG. 4 is a top view of the said male oriented portable sanitary facility illustrating the manner in which a privacy screen, fence, tent or the like may be incorporated when it is set up for use;

DETAILED DESCRIPTION OF THE INVENTION

Figure 1:
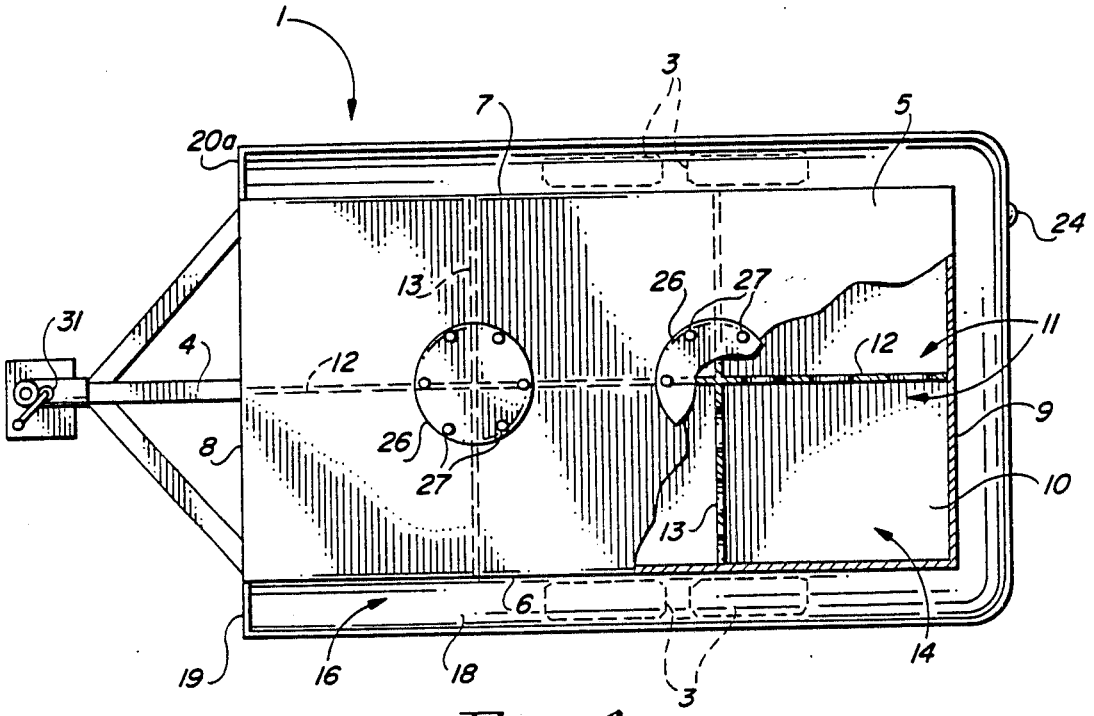
FIG. 1 is a partially cut away top view of the portable sanitary facility especially adopted for male only use particularly showing the relationship of a liquid receiving trough to a liquid storing main compartment and the orientation of vertical baffles which serve to divide the main compartment into a plurality of sub-compartments.
Figure 2:
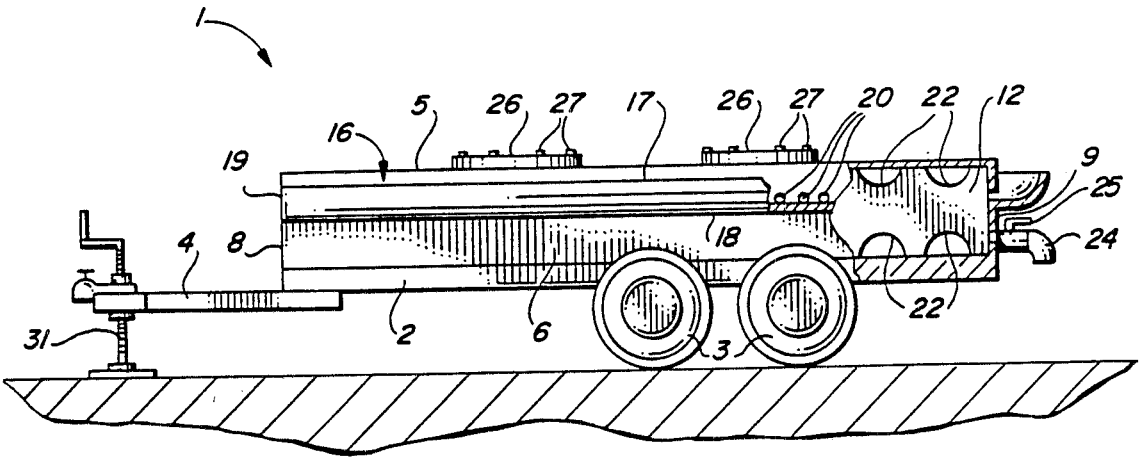
FIG. 2 is a partially cut away side view of the sanitary facility of FIG. 1 showing certain details of the structure of the liquid receiving trough, certain liquid communication apertures included in the facility walls and another view of the vertical baffles.

FIGS. 1 through 4 show specifically a first embodiment for male use. Referring now to FIGS. 1 and 2, it will be observed that the portable sanitary facility generally indicated at 1 includes a trailer frame 2 supported for rolling transport by at least one pair of wheels 3. Because the facility is heavy when loaded with liquid and a liquid load is inherently unstable (tending in motion to shift fore and aft and from side to side), it is preferred that two pairs of wheels 3 be incorporated to support the trailer frame 2 as shown in the figures.

Extending forwardly from the trailer frame is a trailer hitch 4 which may be conventionally coupled to a towing vehicle for transport between usage sites, disposal sites, and storage sites. In addition, as shown in FIG. 2, the trailer hitch 4 may be supported by a jackstand 31 to establish, in conjunction with the wheels 3, a generally level and stable configuration during both use and storage. Optionally, the jackstand 31 may be vertically adjustable to facilitate leveling the facility.

A top 5, a left wall 6, a right wall 7, a fore wall 8, an aft wall 9 and a bottom 10 connecting the walls cooperate to define a main compartment 11 of about the same length and width as the trailer frame 2. The main compartment 11 is divided into a plurality of sub-compartments by at least one fore and aft vertical baffle 12 extending between the fore 8 and aft 9 walls and at least one side to side vertical baffle 13 extending between the left 6 and right 7 side walls. Thus, as shown in the broken away portion of FIG. 1, the left side wall 6, a side to side vertical baffle 13, the fore and aft vertical baffle 12 and the left end of aft wall 9 serve to define an exemplary left rear sub-compartment 14.

A horizontal trough 16 extends around at least a portion of the main periphery of the main compartment 11 and preferably, as best shown in FIG. 1, along the full length of the left and right sides and across the aft end. The trough 16 has an outer lip 17 and a bottom 18 which engages the walls 6, 7, 9 in a liquid tight joint along the trough length. The forward ends 19, 20a, of the trough 16 are closed off to the height of the lip 17 such that it will be understood that the entire trough cooperates with the walls 6, 7, 9 to provide a liquid receiving receptacle around the facility periphery.

As best shown in the partially broken away section of the trough 16 in FIG. 2, drain apertures 20 are provided in the walls 6, 7, 9 adjacent the trough 16 and are vertically situated in the walls within a region which is slightly higher than the trough bottom 18 and lower than the upper edge of the outer lip 17 of the trough. The apertures 20 are distributed more or less uniformly along the length of the trough. Thus, it will be understood that any liquids introduced into the trough 16 will pass through the apertures 20 into the main compartment 11 of the facility for holding.

Referring particularly to FIGS. 2 and 3, it will be observed that the baffles 12, 13 include apertures 22, 23, respectively, which serve to establish liquid communication between adjacent sub-compartments. To achieve equalization of the liquid load across the several sub-compartments and to facilitate eventual drainage of the load at a disposal site, at least one of the apertures 22, 23 in each baffle section comprising a sub-compartment wall should be situated at the baffle bottom to establish liquid communication between all adjacent sub-compartments for any level of load.

The purpose of the baffles 12, 13 is to prevent inordinate shifting of the liquid load during towing to a disposal site, which shifting would otherwise result from acceleration and deceleration and side to side motion of the trailer. The provision of the baffles and the resultant sub-compartments markedly improves the stability of the facility during the towing process.

As best shown in FIGS. 2 and 3, an outlet drain 24 is provided in the aft wall 9 at a low position. Liquid communication through the outlet drain 24 is controlled by a valve 25 which is closed during use of the facility and may be opened at a disposal site to drain the main compartment 11. Thus, by slightly raising the fore end of the trailer, all sub-compartments of the main compartment 11 may be thoroughly drained.

Referring again to FIGS. 1 and 2, it will be observed that removable access covers 26, held in place by bolts 27, are situated generally at the intersections of the vertical baffles 12, 13 and serve to provide access through the top panel 5 into all the sub-compartments of the main compartment 11. Thus, each of the sub-compartments may be entered during the fabrication process and also afterwards as may be convenient.

Attention is now directed to FIG. 4 wherein the facility 1 is illustrated as it may be set up for use within a walled structure 28 having an entrance 29 inside which is situated a modesty screen 30. The walled structure 28 may simply be a fence of adequate height, or for added weather protection, may be a tent-like structure. In order to obtain improved air circulation, one desirable embodiment of the walled structure 28 includes an overhead canopy (not shown) suspended above the facility 1.

A portable sanitary facility in accordance with the present invention having dimensions on the order of 6½ feet wide, 12½ feet wide and 2 feet deep has sufficient capacity to handle a crowd including about 8,000 males for a day. The wall, baffles, bottom and top of the sanitary unit may be fabricated from such diverse materials as fiberglass and stainless steel. Preferably, the trough is fabricated from stainless steel.

Figure 5:
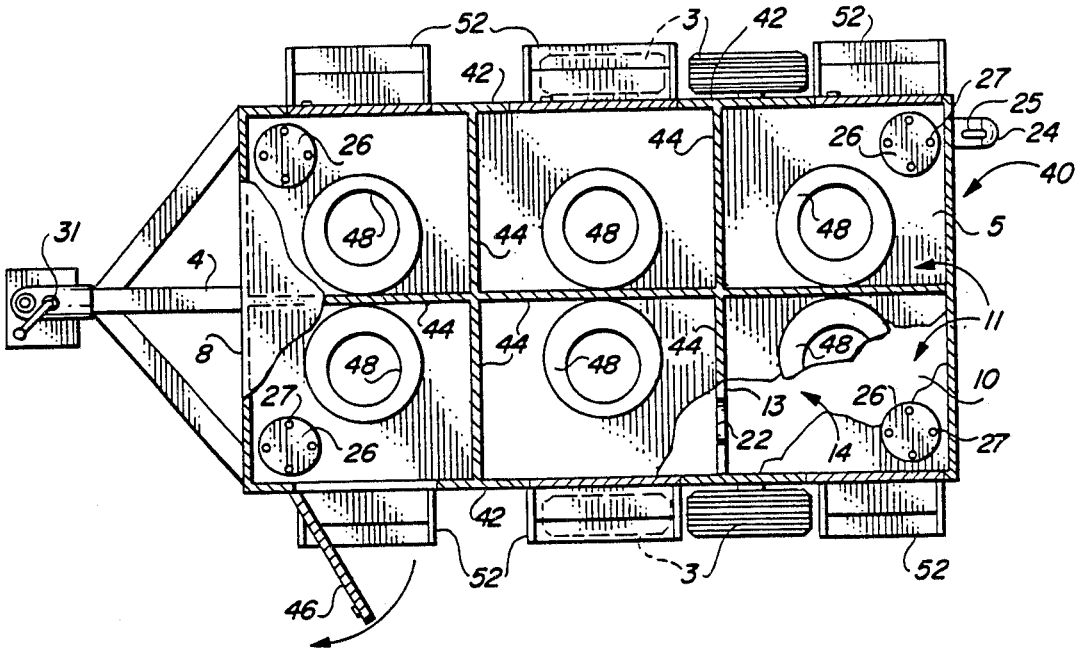
FIG. 5 is a partially cut away, top view of the portable sanitary facility's second embodiment which is for more general female and male use which corresponds in pertinent part to the view of FIG. 1, and which shows a facility having a housing with compartments which, for this view, are removed, the better to see the arrangement of toilet seat and toilet seat openings in the top wall of the compartment.
Figure 6:
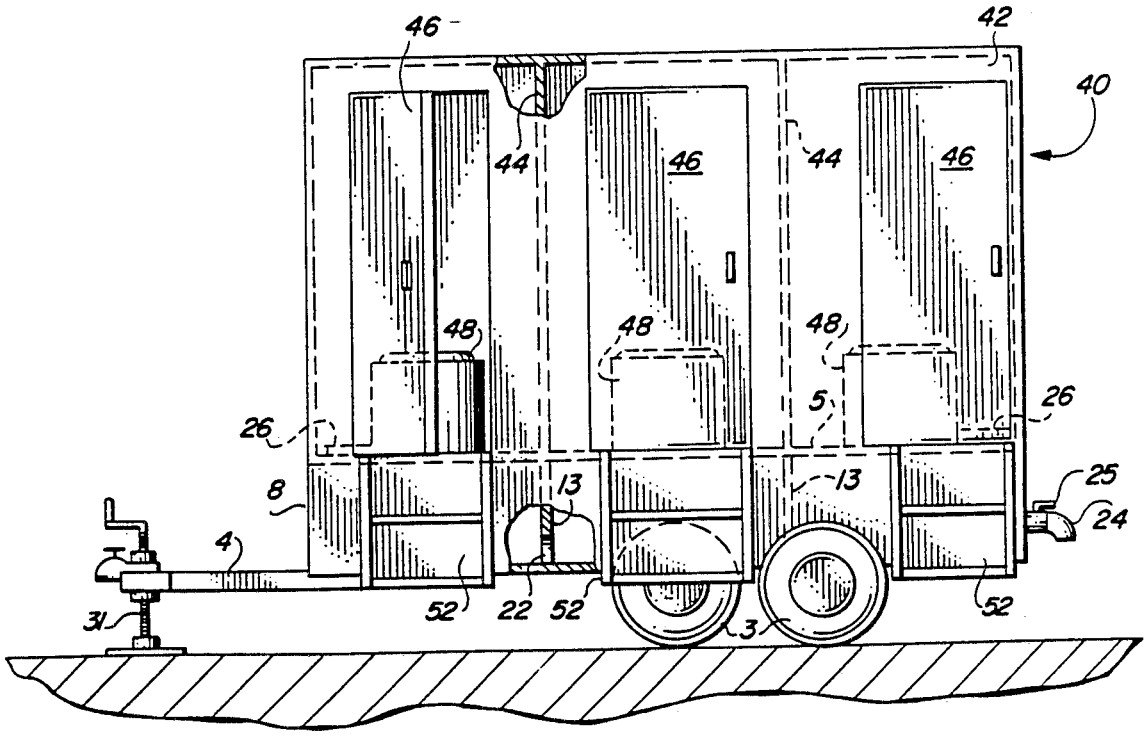
FIG. 6 is a side elevation of the sanitary facility of FIG. 5 showing certain schematic details of the structure of the housing and toilet seat arrangement, which view corresponds in pertinent part to the view of FIG. 2 in the male embodiment.

FIGS. 5 and 6 are the female and general purpose counterparts to the male only embodiment of the invention and there are numerous identical elements in the two embodiments which serve the same function. In such cases, the numbering has been carried over into FIGS. 5 and 6.

The differences may be seen in the provision of a housing 40 which has outside walls 42, partitions 44, and exterior doors 46 which give access to private rooms defined by the partitions 44. In the private rooms are toilet seats 48 through which access to the sub-compartments are obtained by means of toilet seat openings 50. Steps 52 are provided below each doorway to permit easy access to the doorway by the user.

Before each public performance appearance the compartment is treated with Aqua Zyme, an enzymatic waste digester, or equivalent, which performs the function of turning solid waste to liquid waste. After the solid waste becomes liquid it is handled internally in the sub-compartments in the same manner as heretofore described for the handling of liquid male waste in connection with the first embodiment.

From a consideration of FIGS. 4 and 6 it will be apparent to those skilled in the art that the two embodiments may be joined end to end to provide a comprehensive facility or either may be used separately, as the occasion demands. Also it will be apparent that if desired the enclosure generally designated as 28 in FIG. 4 may be used also to enclose the female or general purpose facility shown in FIGS. 5 and 6.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A portable sanitary facility for males comprising:

(A) a trailer; said trailer including:

1. a trailer frame;
2. wheels disposed on both sides of and at least partially supporting said trailer and frame;
3. a forwardly extending trailer hitch adapted to couple the trailer to a towing vehicle;

(B) a sanitary unit carried by said trailer; said sanitary unit comprising:

1. a main compartment having a top, a bottom, fore and aft end walls, and left and right side walls, said walls collectively defining a periphery of said main compartment;
2. a trough comprising a bottom and an outer lip having an upper edge; said trough being fixed to and extending about at least a portion of said main compartment periphery and cooperating therewith to define a liquid receiving receptacle; and
3. a plurality of apertures in said walls disposed adjacent said trough and vertically situated in said walls within a region which is higher than said trough bottom and lower than said upper edge of said trough lip;

whereby liquid introduced into said receptacle drains into said main compartment for retention therein such that said facility may be later towed to a disposal site for disposal of the retained liquid.

2. The portable sanitary facility of claim 1 which further includes inside said main compartment:

(A) at least one fore and aft vertical baffle extending between said fore and aft end walls;

(B) at least one side to side vertical baffle extending between said left and right side walls;

(C) said fore and aft vertical baffle and said side to side vertical baffle joining intermediate their respective lengths to define, in conjunction with said fore and aft end walls and said left and right side walls, a plurality of sub-compartments in said main compartment.

3. The portable sanitary facility of claim 2 in which a plurality of apertures are provided in said vertical baffles to establish liquid communication between all adjacent sub-compartments.

4. The portable sanitary facility of claim 3 which includes (A) an outlet for establishing liquid communication between the interior and the exterior of said main compartment; and (B) a valve in said outlet for selectively opening and closing said outlet;

whereby said outlet may be closed off during use of the facility and during transport of the facility to a disposal site and may be opened to drain the liquid contents from said main compartment at the disposal site.

5. A portable sanitary facility comprising:

(A) a trailer; said trailer including:

1. a trailer frame;
2. wheels disposed on both sides of and at least partially supporting said trailer and frame;
3. a forwardly extending trailer hitch adapted to couple the trailer to a towing vehicle;

(B) a sanitary unit carried by said trailer; said sanitary unit comprising;

1. a main compartment having a top, a bottom, fore and aft end walls, and left and right side walls, said walls collectively defining a periphery of said main compartment; said top having at least one means defining a toilet seat and toilet seat aperture communicating with said main compartment.
2. at least one fore and aft vertical baffle extending between said fore and aft end walls;
3. at least one side to side vertical baffle extending between said left and right side walls;
4. said fore and aft vertical baffle and said side to side vertical baffle joining intermediate their respective lengths to define, in conjunction with said fore and aft end walls and said left and right side walls, a plurality of sub-compartments in said main compartment.

6. The portable sanitary facility of claim 5 in which a plurality of apertures are provided in said vertical baffles to establish liquid communication between all adjacent sub-compartments.

7. The portable sanitary facility of claim 6 which includes (A) an outlet for establishing liquid communication between the interior and the exterior of said main compartment; and (B) a valve in said outlet for selectively opening and closing said outlet;

whereby said outlet may be closed off during use of the facility and during transport of the facility to a disposal site and may be opened to drain the liquid contents from said main compartment at the disposal site.

8. A portable sanitary facility comprising:

I. a trailer; said trailer including:

a. a trailer frame;
b. wheels disposed on both sides of and at least partially supporting said trailer and frame;
c. a forwardly extending trailer hitch adapted to couple the trailer to a towing vehicle;

II. a sanitary unit carried by said trailer; said sanitary unit comprising:
a. a male section comprising:
1. a main compartment having a top, a bottom, fore and aft end walls, and left and right side walls, said walls collectively defining a periphery of said main compartments;
2. a trough comprising a bottom and an outer lip having an upper edge; said trough being fixed to and extending above at least a portion of said main compartment periphery and cooperating therein to define a liquid receiving receptacle; and
3. a plurality of apertures in said walls disposed adjacent said troughs and vertically situated in said walls within a region which is higher than said trough bottom and lower than said upper edge of said trough lip; whereby liquid introduced into said receptacle drains into said main compartment for retention therein such that said facility may be later towed to a disposal site for disposal of the retained liquid; and
b. a female or general purpose section comprising:
1. a main compartment having a top, a bottom, fore and aft end walls, and left and right side walls, said walls collectively defining a periphery of said main compartment; said top having at least one means defining a toilet seat and toilet seat aperture communicating with said main compartment.
2. at least one fore and aft vertical baffle extending between said fore and aft end walls;
3. at least one side to side vertical baffle extending between said left and right side walls;
4. said fore and aft vertical baffle and said side to side vertical baffle joining intermediate their respective to define, in conjunction with said fore and aft end walls and said left and right side walls, a plurality of sub-compartments in said main compartment.

9. The portable sanitary facility of claim 8 in which a plurality of apertures are provided in said vertical baffles to establish liquid communication between all adjacent sub-compartments.

10. The portable sanitary facility of claim 9 which includes
(A) an outlet for establishing liquid communication between the interior and the exterior of said main compartment; and
(B) a valve in said outlet for selectively opening and closing said outlet; whereby said outlet may be closed off during use of the facility and during transport of the facility to a disposal site and may be opened to drain the liquid contents from said main compartment at the disposal site.

* * * * *

UNITED STATES PATENT AND TRADEMARK OFFICE

CERTIFICATE OF CORRECTION

PATENT NO. : 4,653,125

DATED : March 31, 1987

INVENTOR(S) : Robert M. Porter

It is certified that error appears in the above-identified patent and that said Letters Patent is hereby corrected as shown below:

In Claim 8, Section II b.4, in line 12 of column 8, the word ---lengths--- should be inserted between "respective" and "to".

Signed and Sealed this

First Day of September, 1987

*Attest:*

*Attesting Officer*

DONALD J. QUIGG

*Commissioner of Patents and Trademarks*